United States Patent [19]

Henning et al.

[11] 4,042,144

[45] Aug. 16, 1977

[54] PULL TAB CONSTRUCTION FOR FULL PANEL PULL-OUT ENDS FOR EASY OPENING CANS

[75] Inventors: George J. Henning, Canton; Lynn B. McKinney; Joseph Scalia, both of Massillon, all of Ohio

[73] Assignee: Van Dorn Company, Cleveland, Ohio

[21] Appl. No.: 740,373

[22] Filed: Nov. 10, 1976

[51] Int. Cl.[2] ..... B65D 41/32

[52] U.S. Cl. ..... 220/273

[58] Field of Search ..... 220/269, 270–273

[56] References Cited

U.S. PATENT DOCUMENTS

| | | | |
|---|---|---|---|
| 3,880,318 | 4/1975 | Fraze | 220/273 |
| 3,941,277 | 3/1976 | McKinney et al. | 220/273 |

*Primary Examiner*—George T. Hall

*Attorney, Agent, or Firm*—Frease & Bishop

[57] ABSTRACT

A sheet metal pull tab for easy opening cans of the full panel pull-out type which has a special and coordinated configuration, shape and contour of pull-ring, keyhole-shaped slot, nose and nose-forming walls which serve readily without tab failure to rupture the score line formed in a can end for removal of an end panel defined by the score line. The new pull tab structure imparts unusual overall strength to the pull tab that enables the pull tab either to provide greater strength when formed from the same gauge sheet metal or to provide the same strength when formed from lighter gauge sheet metal as compared with similar prior sheet metal pull tabs having the same outer contour; and also to provide such a pull tab structure which reduces the amount of metal, disregarding gauge, that is required to form the strong pull tab structure.

17 Claims, 22 Drawing Figures flat top wall portions 35, about the center of the rivet hole 32 (as on section line 9—9 of FIG. 1, and FIG. 9) is about half the greatest width of the wide flat top wall portions 26, and much wider than the flattened bead top wall 19.

The outer pull tab bead formed by outer curved sides 20 and inturned flanges 21 extends along inwardly curved portions 25 and terminates at ends 36 in flattened portions 37 which are squeezed upward at an angle toward top wall portions 35 (FIG. 10). The pull tab nose flat top wall 35 and the angled vertical walls 29 in the zone where the walls 29 would intersect, are reformed downwardly toward the nose bottom wall 30 to provide a small generally rectangularly-shaped nose tip 38 which has a slightly rounded outer edge 39 and which is offset or stepped slightly upwardly at 40 above the plane of the triangular nose bottom wall 30, as best shown in FIG. 3.

The narrowed flat top nose wall portions 35 between the outer bead terminal ends 36 and nose tip 38 terminate in spaced ears 41 and angled edges 42 (FIGS. 1 and 2). The spaced ears 41 are the stubs which remain where tab carrying strips are severed which form the connection of each tab in the strip which is fabricated in progressive dies for the manufacture of the pull tabs, as explained below.

An important facet of the invention relates to the ability to manufacture the improved pull tab 1 in slightly modified progressive dies that originally were designed for the manufacture of pull tabs such as shown in U.S. Pats. Nos. 3,762,596 and 3,838,788, for example. Large capital savings accrue by such modification of original dies rather than scrapping the dies and related equipment for assembling the pull tabs to can ends, and building a completely new set of dies.

FIGS. 11, 12 and 12A show diagrammatically various stages in multi-stage progressive die press equipment having four lines for producing four pull tabs with each stroke of the press while continuous strip stock 43, from which the pull tabs are fabricated, is moved forward one stage at a time between each press stroke.

FIG. 11 illustrates a stage operation just prior to severing the carrying strips 44 to discharge the pull tabs 1 from the strip stock 43 as completed pull tabs. Shearing the carrying strips 44 produces the ear stubs 41. The shear line 45 (FIGS. 11 and 12) results at one of the early progressive die stages and defines the initial severing of a flat pull tab blank, except for carrying strips 44, from the strip stock 43 prior to stage operations which form the bead around the ring portion 12, etc.

This punch shear line 45 fundamentally is identical to that in the progressive dies originally built to manufacture pull tabs such as shown in U.S. Pat. No. 3,762,596. Several progressive die stage operations are shown in FIG. 12, at 46, 47, 48 and 49. At stage 46, some portions of the tab blank 46A have been formed completely.

The stage formation of nose portions of the blank 46A are illustrated in FIG. 12A. At the zone between the carrying strips 44, the blank sheet metal projects nearly vertically upward in a slightly rounded wall 50. The thickness of the sheet metal of the strip blank 43 is illustrated diagrammatically in FIG. 12A by the double lines for wall 50. The formation of the triangular nose bottom wall 30 at stage 46 is indicated. The angled vertical walls 29 of the blank 46A also are indicated.

However, these angled walls 29 in FIGS. 12 and 12A intersect at an apex or point 51 lying immediately adjacent the upper surface (viewing FIGS. 12A) of the upstanding wall 50. This upper surface will become the top surface of the nose tip 38. The upstanding wall 50 includes the metal from which the nose tip 38 is formed in the next die stage operation 47.

In stage operation 47 the upstanding wall 50 is reformed, downward toward the nose bottom wall 30, and is extended slightly forward of the nose end of the tab, as shown in FIGS. 1 and 2. At stage 47, the angular shape of the offset nose tip is formed as illustraed in FIGS. 7 and 8.

The next stage operation 48 illustrated in FIG. 12 may involve the formation of the bend corners 15 in the pull tab ring portion 12.

The stage operation 49 in FIG. 12 may involve punching the rivet hole 32 in the ear 31. The ear 31 was formed in previous operations when metal forming the keyhole-shaped slot was punched out.

The described configuration, shape and contour of the pull ring, keyhole-shaped slot, nose and nose-forming walls, and the coordinated relation therebetween which characterize important concepts of the invention result in innumerable advantages.

Thus, the structure of the finished pull tab 1 provides overall strength to the pull tab nose greater for the same gauge metal, or the same strength for thinner gauge metal, than the strength of prior pull tabs of the type shown, for example, in U.S. Pats. Nos. 3,762,596 and 3,891,117, which have the same outer contour.

This feature is of tremendous importance in that the trade has called for increased pull tab strength. Without the new structure of the concepts of the invention, increased strength could be achieved with old pull tab structures of the type shown in the patents noted, insofar as we are aware, only by increasing the metal thickness of the strip stock used in the manufacture of the pull tabs. This in turn would require revision of progressive die lines used to manufacture the prior pull tabs in order to accept increased metal stock thickness. This in turn would involve heavy capital expenditures. By obtaining increased strength without increasing the strip stock thickness, capital expenditures are reduced.

In addition to obtaining increased strength with the same strip stock metal thickness, and with modification of only certain dies in certain of the progressive die stage operations to produce the new pull tab structures, a further advantage has accrued in that less metal is required for the new pull tabs because of providing the open keyhole-shaped slot formation wherein more metal is removed than in the manufacture of pull tabs of the type shown, for example, in said U.S. Pats. Nos. 3,762,596 amd 3,891,117.

Another advantage of the new keyhole-type pull tab is the ability to easily bend the nose bottom wall 30 along a line extending between the terminal zones 34 of the curved slots when the pull tab is manipulated to open a can as described below in connection with FIGS. 13, 14, 15 and 16.

The keyhole-shaped slot structure of the improved pull tab provides great longitudinal stiffness laterally at either side of the bend line extending between the terminal zones 34 because of the reinforcement imparted by the wide flat top nose walls 35 and the even wider flat top wall zones 26 extending between the outer reinforcing beads and the vertical parallel keyhole forming walls 23 and their inward curved portions 28 and the angled vertical walls 29.

These stiff and strong reinforced top walls 26 which merge into the top nose walls 35 and their vertical sup-

DESCRIPTION OF THE PREFERRED EMBODIMENTS

First Embodiment

The invention is illustrated typically in the drawings with the improved pull tabs assembled to small size cans, although the cans may be of any one of a number of sizes or capacities, or of any one of a number of types made by various manufacturers and which have a continuous score line in the can end member adjacent the double seam between the can body and can end which defines a full panel to be pulled out by manipulation of a pull tab.

FIGS. 1 through 18 illustrate the improved pull tab used in connection with a plain can end. However, the pull tab structure incorporating the concepts of the present invention is universal in use in that it may be used for can ends provided with a protective fold at the peripheral edge of the removed panel such as described below under the heading — Second Embodiment — wherein there preferably is only a slight change in the size and shape of the pull tab rivet-receiving aperture.

The improved pull tab, generally indicated at 1, is shown in FIG. 4 riveted at 2 to a plain panel 3 defined by a score line 4 in the can end 5 which is seamed by a doube seam 6 to the upper or open end of the side walls 7 of a can generally indicated at 8. The can 8 is generally of conventional construction having a cup-shaped body with the side walls 7 extending upwardly from a bottom wall. The can end member 5 has a recessed corner 9 at the lower end of the double seam 6 located above the ledge or shoulder formed by an inwardly projecting annular bead 10 formed in the side walls 7 below the seam 6.

The cam end 5 typically has a recess 11 embossed downwardy inwardly in a central portion thereof to receive and facilitate the grasping of the ring portion 12 of the pull tab 1. The pull tab ring portion 12 is provided with a downwardly curved shape indicated at 13, extending from (FIG. 13) the recess-defining corner 14 to a bend corner 15 in a pull tab ring portion 12. The extremity 16 of the ring portion 12 extends upward beyond the bend corner (FIG. 13) to facilitate grasping of the pull tab.

Preferably, a pair of rounded upwardly projected bosses or knobs 17 are formed in the can end 5 located outside of recess 11 and triangularly with respect to the nose end of the pull tab adjacent the rivet 2 so as to form three-point supports for cans 8 when stacked as shown in FIG. 17. Thus, the pull tab 1 when assembled to a can end 5 has its curved portion 13, bend corner 15 and ring extremity 16 located in the can end recess 11, as well shown in FIGS. 4, 5 and 13 so as not to interfere with proper and stable stacking of cans either in shipping cartons or during counter or shelf display of food products contained in easy open cans 1.

The special and coordinated configuration, shape and contour of the pull ring, keyhole-shaped slot, nose and nose-forming walls of pull tab 1 which characterize the invention are best shown in FIGS. 1, 2, 3, 7, 8, 9 and 10.

The pull tab ring portion 12 is slightly greater than semicircular in form as viewed in FIGS. 1 and 2. Ring portion 12 has a flattened bead shape in cross section, as indicated at 18 in FIGS. 3 and 14. The flattened bead shape is somewhat oval in section and has a flat top wall 19 and curved sides 20 terminating in inturned flanges 21. The inner surface of the circularly-shaped portion of the keyhole shaped slot merges with reversely curved portions 22 extending toward the nose end of the pull tab 1. Curved portions 22 have large diameter sweeping curves that merge into parallel vertical wall portions 23 which define the narrow portion of the keyhole-shaped slot.

The outer perimeter of the pull tab 1 extends fowardly from the ring portion 12 in parallel sides 24 which curve inwardly at 25 at each side toward the nose end of the pull tab. The flat top 19 of the ring portion 12 continues from the ring portion 12 to form the widened flat zones or top walls 26 of the pull tab (FIG. 1), which zones 26 extend, on the inside, from the inner curved portions 22 and along the parallel walls 23 of the narrow portion of the keyhole slot, and on the outside, from the parallel sides 24 and along the inward curves 25. The beaded outer edges of the widened flat top walls 26 continue as curved side and inturned flange extensions 20A and 21A of the same parts 20 and 21 of the ring portion 12 (FIG. 8).

Similarly, the beaded inner or keyhole slot edges of the widened flat top walls 26 along the reversely curved portions 22 of the pull tab continue as curved side and inturned flange extensions 20B and 21B (FIG. 2) of the same parts 20 and 21 of the ring portion 12. However, the flange portions 21B terminate at 27 where the reversely curved portions 22 merge with the parallel vertical wall portions 23. Also, at the zones 27 the curved side portions 20B change shape and merge into and become the vertical slot walls 23 (FIG. 8).

The parallel vertical wall portions 23 (viewing FIGS. 1 and 2) at the nose end of the pull tab curve inwardly at 28 and merge into straight vertical wall portions 29 which are angled inwardly to form important portions of the pull tab nose.

In accordance with the invention, the straight vertical wall portions 29, each are angled at 45° from a horizontal centerline which may be represented by the section line 3—3, FIG. 1. Thus, the angled vertical nose walls 29 form an included 90° angle, the location of the apex of which is described below.

The angled vertical nose walls 29 extend down from the flat top wall to a generally triangularly shaped nose bottom wall 30, having an ear 31 projecting from wall 30 toward the ring portion 12.

The ear 31 is formed with an aperture 32 which receives the rivet 2 when the pull tab 1 is assembled with a can end 5. The nose bottom wall 30 is connected at its rear outer corners by narrow tapered side extensions 33 located at either side of and spaced from the ear 31, to the lower ends of the parallel keyhole vertical slot walls 23 (FIGS. 1, 2 and 8). The extensions 33 terminate (FIGS. 1 and 2) adjacent the terminal zones 27 where the curved portions 22 merge with the parallel vertical wall portions 23.

Thus, viewing FIGS. 1 and 2, the generally triangular nose bottom wall 30, the ear 31 and the side extensions 33 form curved slots between the ear 31 and extensions 33, and the slots terminate at spaced zones 34. The slot terminal zones 34 generally define outer rear corners of the triangularly shaped bottom wall 30, along with the angled vertical walls 29; and the ear 31 extends rearward from the triangular nose bottom wall 30.

The widened flat top walls 26 become narrower at the nose end of the pull tab between the curved portions 25 of the pull tab outer perimeter and the inward curved and straight vertical wall portions 23 and 29, as indicated at 35 (FIG. 9). The radial width of the narrower These objectives and advantages are obtained by the pull tab structure, the general nature of which may be stated as including in a sheet metal pull tab for a full panel pull-out easy opening metal can, flat top and rounded outer side walls forming a tab perimetric contour defined by spaced curved tab ring and nose ends connected by parallel tab sides; the flat tab top wall having an inner side wall defining a keyhole-shaped slot; the contour of the keyhole slot including a curved ring portion at the curved tab ring end connected by reversely curved portions to parallel portions extending toward the tab nose end; the rounded outer tab side wall having an inturned bead-forming flange extending around the tab perimeter ring end, parallel sides, and portions of the curved nose end, and ending in spaced bead terminals; the curved tab ring portion inner side wall being rounded and having an inturned bead-forming flange at the ring end, said last-mentioned bead-forming flange terminating at the reversely curved portion connections with said parallel keyhole portions; the inner keyhole slot side wall parallel portions being connected adjacent the tab nose end by portions curved inwardly toward the nose end; said last-mentioned inward curved inner side wall portions being connected with straight wall portions angled at 90° toward each other; the angled straight wall portions at the tab nose end extending downward from the flat tab top wall to and being connected with a generally right triangularly-shaped flat nose bottom wall; the parallel, inwardly curved, and straight angled tab inner side wall portions extending vertically downward from the flat tab top wall and vertically with respect to said flat nose bottom wall; the flat tab top wall at the tab nose end and the 90° angled straight tab inner side wall portions merging in a generally rectangular flat nose tip offset upward from the nose bottom wall in the zone of the projected intersection of the angled straight vertically oriented tab inner side wall portions; an ear extending rearward from the nose bottom wall; there being rivet-receiving aperture means formed in the ear; a narrow tapered side extension of the nose bottom wall located at either side of and spaced from the ear projecting toward the ear from the lower ends of the parallel keyhole vertical side wall portions; the narrow tapered side extensions terminating rearward of the nose bottom wall where the reversely curved inner side wall portions merge with the keyhole parallel inner side wall portions; there being curved slots formed between the ear and tapered side extensions; the curved slots having terminal zones located at hypotenuse corners of the right triangular nose bottom wall; the nose bottom wall right-angled corner being located adjacent the rectangular nose tip; the flat tab top wall having maximum width between adjacent parallel outer side and inner keyhole walls laterally of a tab centerline passing through the nose tip and rivet-receiving aperture means; and the flat tab top wall having a nose portion between each bead terminal and a straight angled nose wall portion approximately ½ the maximum top wall width measured on a line extending radially of the center of the rivet-receiving aperture means.

BRIEF DESCRIPTION OF THE DRAWINGS

Preferred embodiments of the improved pull tab structure of the invention — illustrative of the best modes in which applicants have contemplated applying the principles — are set forth in the following description and shown in the drawings and are particularly and distinctly pointed out and set forth in the appended claims.

Similar numerals refer to similar parts throughout the various figures of the drawings.

PULL TAB CONSTRUCTION FOR FULL PANEL PULL-OUT ENDS FOR EASY OPENING CANS

BACKGROUND OF THE INVENTION

1. Field of the Invention

Figure 1:
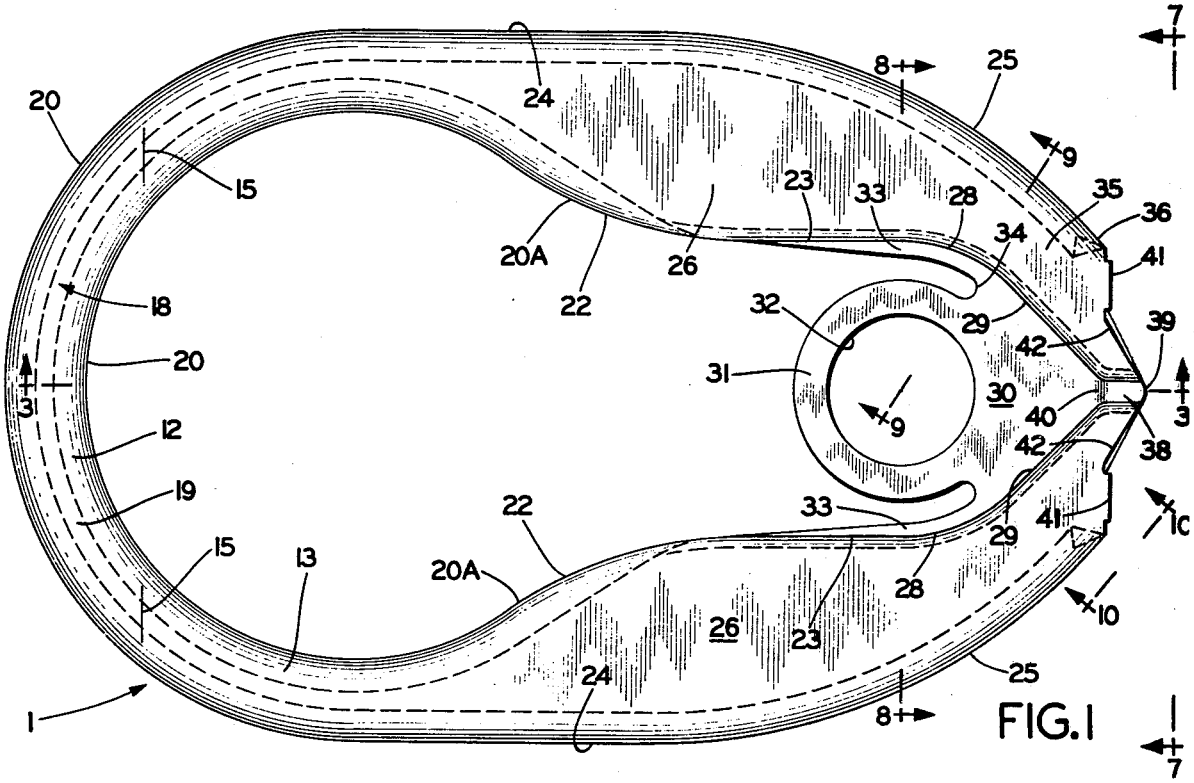
FIG. 1 is a greatly enlarged top plan view of a pull tab having the improved structure.

The invention relates to food product cans provided with can end members which may be opened easily by tearing with a ring pull tab, a full opening removable panel portion from the can end to which panel portion the tab is riveted, the tearing proceeding along an endless score line formed in the can end member which defines the panel; and more particularly to providing unusual stiffness and strength in relatively thin sheet metal material used to manufacture the ring pull tab, which strength is imparted by a special coordinated configuration, shape, contour and design of formed metal portions of the pull tab while at the same time requiring a minimum amount of metal; such pull tab structure being universal in use, either for a plain can end or a can end provided with a protective fold at the peripheral edge of the removed panel.

2. Description of the Prior Art

Many prior patents show various designs, shapes and configurations of ring pull tabs adapted to be riveted to end members of full panel pull-out ends of cans used particularly in the food products industry, such as U.S. Pats. Nos. 3,762,596, 3,838,788, 3,891,117 and 3,941,277. The ring pull tabs shown in each of said patents have the same general shape or outer perimeter configuration. Each is lanced partially around the rivet connection of the pull tab to the can end. The lance is formed in the body of the pull tab which extends from a complete circular ring portion, and the body is surrounded by a connected upwardly directed wall, part of which is connected to the complete ring. The various pull tabs shown in said patents have specifically different structures and are used as described in said patents for both plain and protective fold-containing can end panels.

Further, the various pull tabs shown in said patents all are adapted to be fabricated in progressive die press equipment having multiple lines such that a plurality, such as four pull tabs, are produced by the press with each stroke of the press, and up to 11 or more operations are carried out proressively in each line of the multiple lines during each stroke of the press.

Another type of pull tab involves a variation in the general structure of those pull tabs shown in the foregoing patents which eliminates the body of the pull tab and the lance formed in such body. The modified prior pull tab has a generally oval shape with an inner opening extending substantially the length of the oval and having an ear extending directly from the nose within the oval opening. The ear is riveted to the removable panel, and a pull tab of this type is shown in U.S. Pat. No. 3,799,390.

The oval pull tab structure also is adapted for fabrication in progressive die press equipment. However, the oval pull tab structure has been found to be weak. It frequently bends and fails across the frame-like portion defining the oval opening just behind the nose at either side of the rivet. Such failure results in inability to rupture the can end at the score line. This has led to the provision of a mustache-like cut or score in the can end between the rivet and the pull-out score line to be ruptured, in an attempt to reduce the amount of force required to be exerted by the pull tab for rupturing the can end along the pull-out score line.

The provision of the mustache-cut or score is not desirable since it reduces the integrity of the can when closed and filled with processed food for distribution and sale.

It is possible to eliminate the mustache cut and its disadvantages and to strengthen the oval-type pull tab by increasing the gauge and thus the amount of metal used in the manufacture of the pull tab. This expedient, however, results in a higher pull tab unit cost, and an increase in the amount of metal used, whereas an objective in the industry is to reduce the amount of meta required for pull tab manufacture while providing necessary strength.

Increased strength by the use of heavier gauge metal has the further disadvantage of requiring a complete redesign of the dies used in the progressive die equipment for fabricating the pull tabs.

These problems have been aggravated further by new specifications in the industry for increasing the metal thickness existing at the bottom of the pull-out score line, termed "increased residual", in order to increase the integrity of a can containing processed food against accidental rupture from any cause, such as during shipment of cans stacked on one another in shipping cartons distributed from a canner to wholesale houses or retail stores, or when cans are stacked on the display or stock counters of retail stores.

The accumulation of these existing complicated and interrelated difficulties concerning pull tabs for easy opening cans of the full panel pull-out type has resulted in a complex problem, and thus an existing need in the art for a pull tab which has increased strength using the same gauge metal, or which has the same strength with the use of reduced gauge metal, or which, disregarding gauge, has increased strength with the use of less metal as compared with the described prior types of pull tabs.

A further problem existing in the art relates to the need for what may be termed a universal pull tab structure, which may be used selectively, either for a plain can end, or for one containing a protective fold which is retained at the peripheral edge of the removed panel when removed.

SUMMARY OF THE INVENTION

Objectives of the invention include providing a new pull tab structure for easy opening cans of the full panel pull-out type which has a special shape and contour of pull ring, keyhole-shaped slot, nose and nose-forming walls which provide increased strength to the pull tab, as compared with prior pull tabs fabricated from the same gauge sheet metal and having the same contoured perimeter so that only minor changes are required to convert existing progressive die fabricating lines for the manufacture of the new tab structure; providing such new tab structure which enables the amount of metal used for each tab to be reduced; providing such new tab structure which permits the can end residual at the score line defining the panel to be pulled out to be increased for increased can integrity without increasing the gauge of the metal from which the pull tab is fabricated; providing such new pull tab structure which provides greatly increased strength against bending adjacent the pull tab nose of a generally oval-type tab; and providing such new pull tab structure which eliminates the described difficulties heretofore present in the art, achieves the indicated objectives simply and effectively, and solves existing problems and satisfies existing needs in the canned food products field.

port walls 23, 28 and 29 provide great strength and stiffness to the nose portion of the pull tab so that required pressures of considerable magnitude can be imparted by the nose tip to a can end wall in manipulating the pull tab 1 to rupture a can end along a panel pull-out score line.

The right triangular nose bottom wall 30 with its forwardly offset rectangular tip formation 38 stiffened by the 90° related vertical nose walls 29 and the extended nose top walls 35, all cooperate to provide strength and stiffness to the pull tab which avoid pull tab failure when the pull tab applies the required pressure to rupture a can end.

The coordinated structural feature providing the improved strength characteristics, flow from the particular configuration of the keyhole-shaped slot with its large sweeping curves 22 between the ring portion 12 and the parallel vertical walls bounding the rivet hole 32 on either side, and from the curved wall connection 28 between the parallel vertical walls 23 and the 90° arranged vertical straight nose walls 29.

Figure 2:
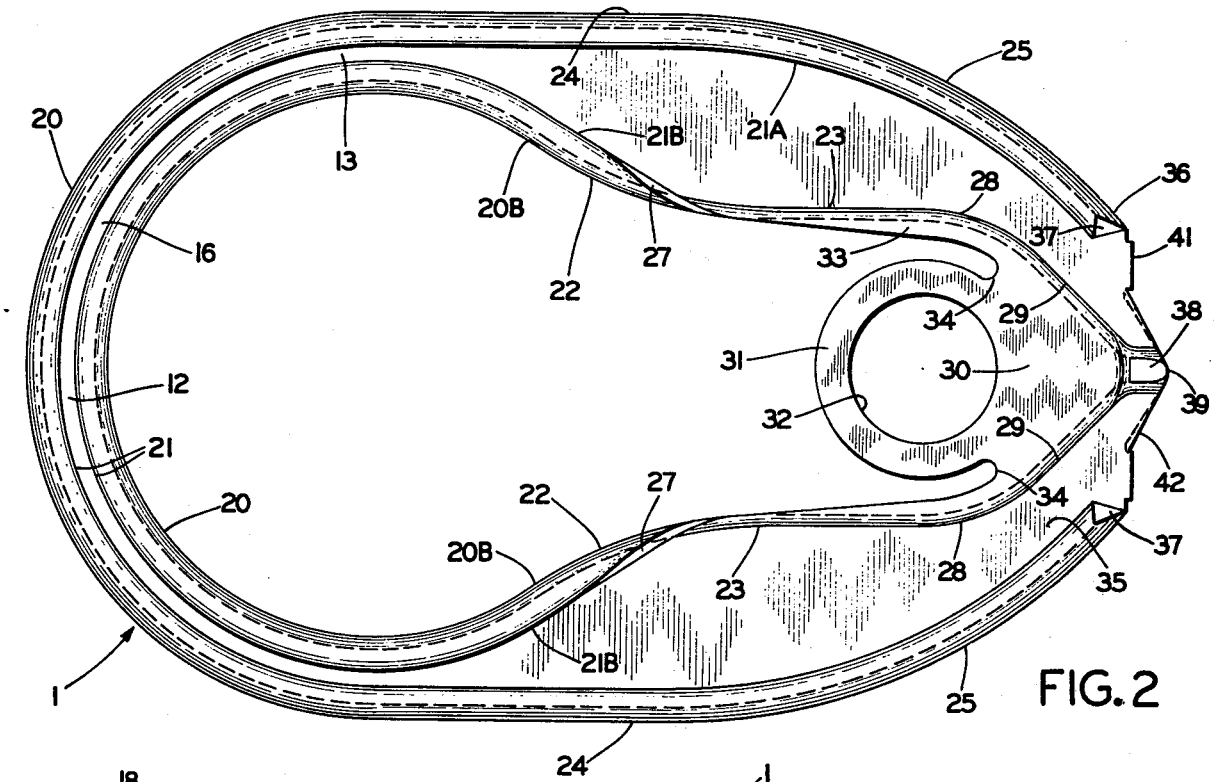
FIG. 2 is a bottom plan view on the same scale of the pull tab shown in FIG. 1.
Figure 3:
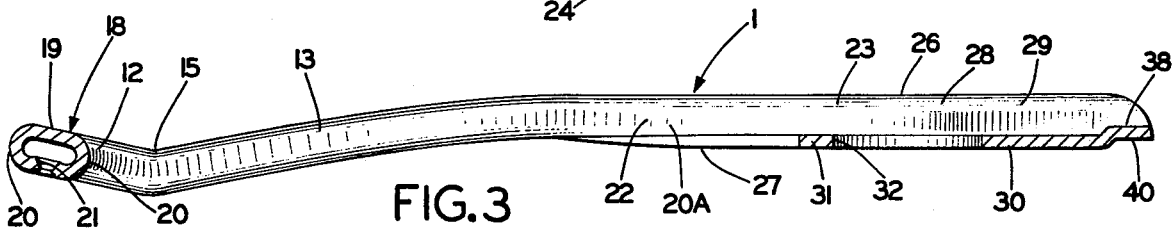
FIG. 3 is a sectional view looking in the direction of the arrows 3—3, FIG. 1.
Figure 7:
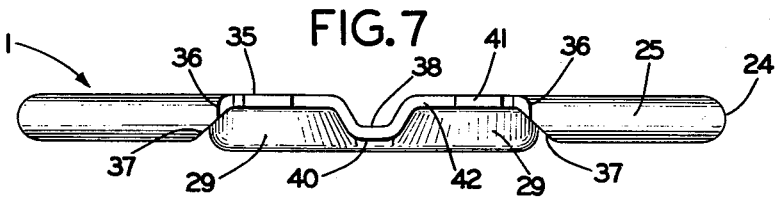
FIG. 7 is an end view looking from the right of FIG. 1 in the direction of the arrows 7—7, FIG. 1.
Figure 10:
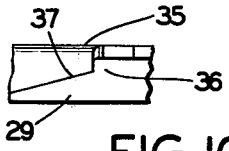
FIG. 10 is a fragmentary view looking in the direction of the arrows 10—10, FIG. 1.
Figure 8:
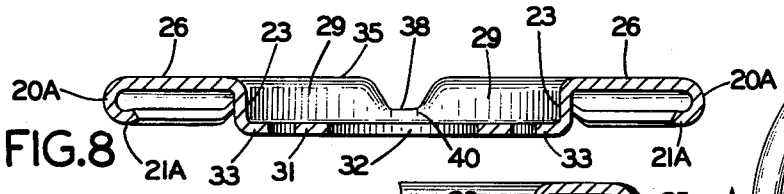
FIG. 8 is a sectiona view taken on the line 8—8, FIG. 1.
Figure 9:
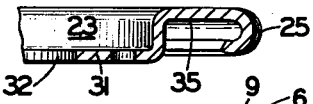
FIG. 9 is a fragmentary section taken on the line 9—9, FIG. 1.
Figure 5:
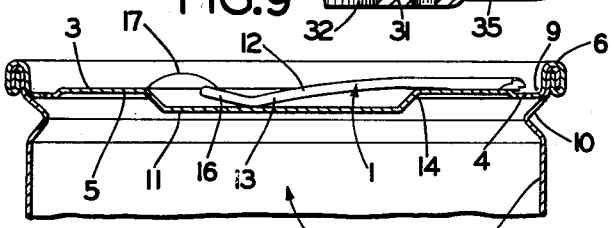
FIG. 5 is an enlarged sectional view looking in the direction of the arrows 5—5, FIG. 4.
Figure 4:
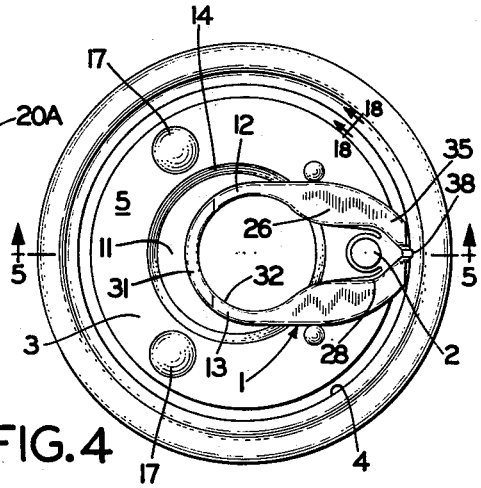
FIG. 4 is a plan view on a smaller scale showing the new pull tab riveted to the full panel pull-out end of an easy opening can.
Figure 12A:
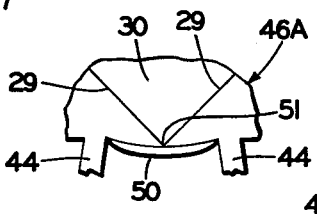
FIG. 12A is an enlarged portion of FIG. 12.
Figure 6:
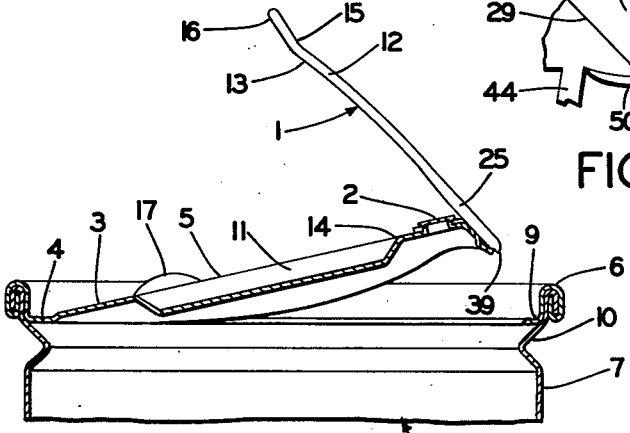
FIG. 6 is a view similar to FIG. 5 showing the panel in the can end of FIG. 5 partially pulled out by manipulation of the improved pull tab.
Figure 12:
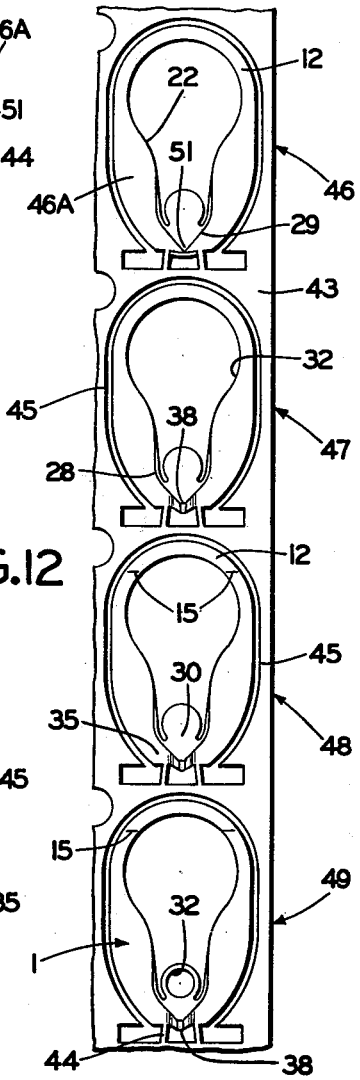
FIG. 12 is a somewhat diagrammatic view similar to FIG. 11 showing four die stage operations preceding severing that may be performed on strip stock in one of the progressive die forming lines.
Figure 11:
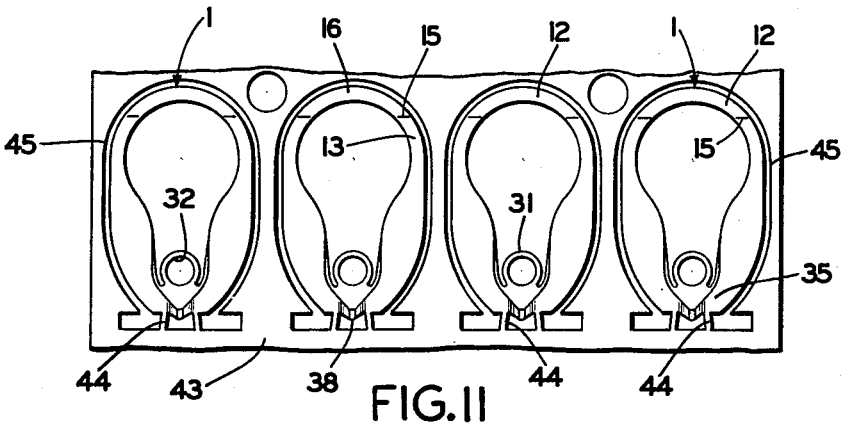
FIG. 11 is a somewhat diagrammatic view showing the last operation of multiple stage operations in the manufacture of the improved pull tabs with progressive die press equipment having four lines in which pull tabs are produced in continuous strip stock, the pull tabs being illustrated just before severing the narrow tab carrying strips.

The increased strength of the pull tab existing in the nose areas, configured as described, is derived from many structual characteristics, including, the substantially vertical form of walls 23, 28 and 29, the 90° included angle between the walls 29, the apex of the intersection of the walls 29 at the point 51 before the upstanding portion 50 of the blank is reformed to provide the nose tip 38, the offset arrangement 40 of the nose tip 38, and the pinch 37 to flatten the terminal ends of the outer bead, together with the relatively large tip area (FIG. 2) of the underside of the nose tip 38.

The pinched or flattened ends 37 of the terminal ends 36 of the outer bead, prevent those terminal bead ends 36 from engaging the can end wall as the pull tab is being manipulated to open a can.

Requirements of the trade have been indicated as calling for increased pull tab strength. The can industry has required greater residual strength in the can end at the score line where the panel is to be pulled out. Heretofore 0.010 inch thick metal can ends have been scored with the residual thickness at the score line of 0.003 inch to 0.004 inch. The residual requirements recently have been raised by canners to provide a 0.0043 inch to 0.0050 inch thickness of metal below the score line in order to improve lid package integrity. This in turn has called for increased pull tab strength.

These matters are illustrated diagrammatically in FIG. 18 where the depth of the score line is indicated at 52 in the strip metal stock 43, and the residual is indicated at 53, being the remaining thickness of the metal in the strip 43 below the score line 52.

Figure 13:
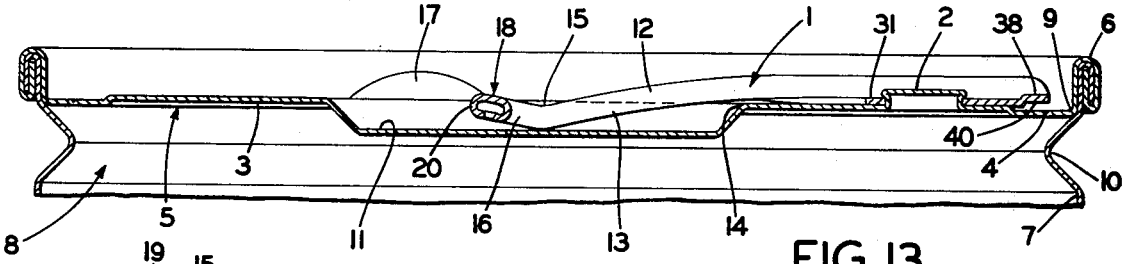
FIG. 13 is an enlarged view similar to a part of FIG. 5 illustrating the pull tab in section along a line similar to the line 5—5, FIG. 4.
Figure 14:
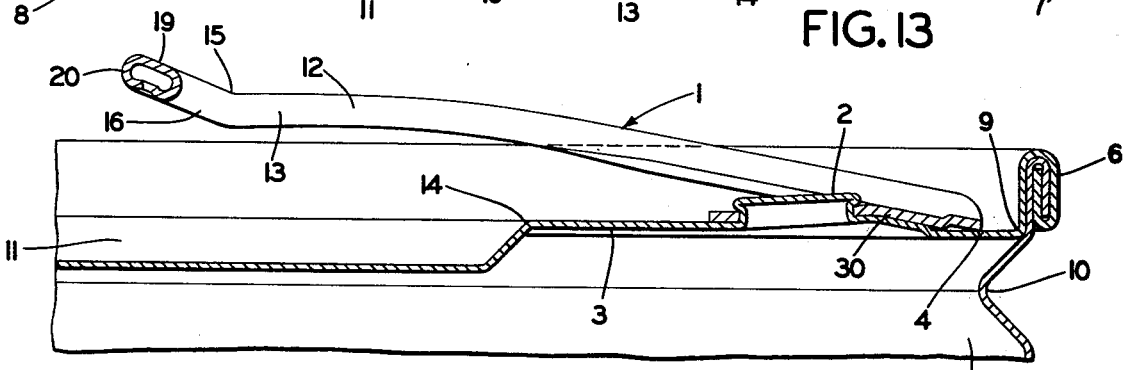
FIG. 14 is an enlarged view of a portion of FIG. 13 showing the pull tab partially elevated to commence the rupture along the panel defining score line of the panel being pulled out.
Figure 15:
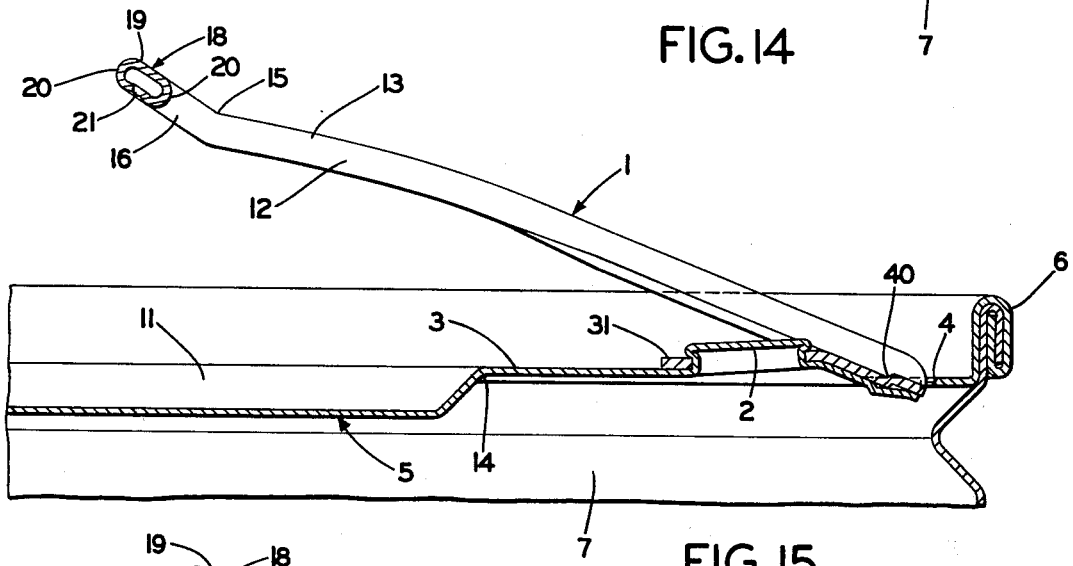
FIG. 15 is a view similar to FIG. 14 showing a further stage in the rupturing operation.
Figure 16:
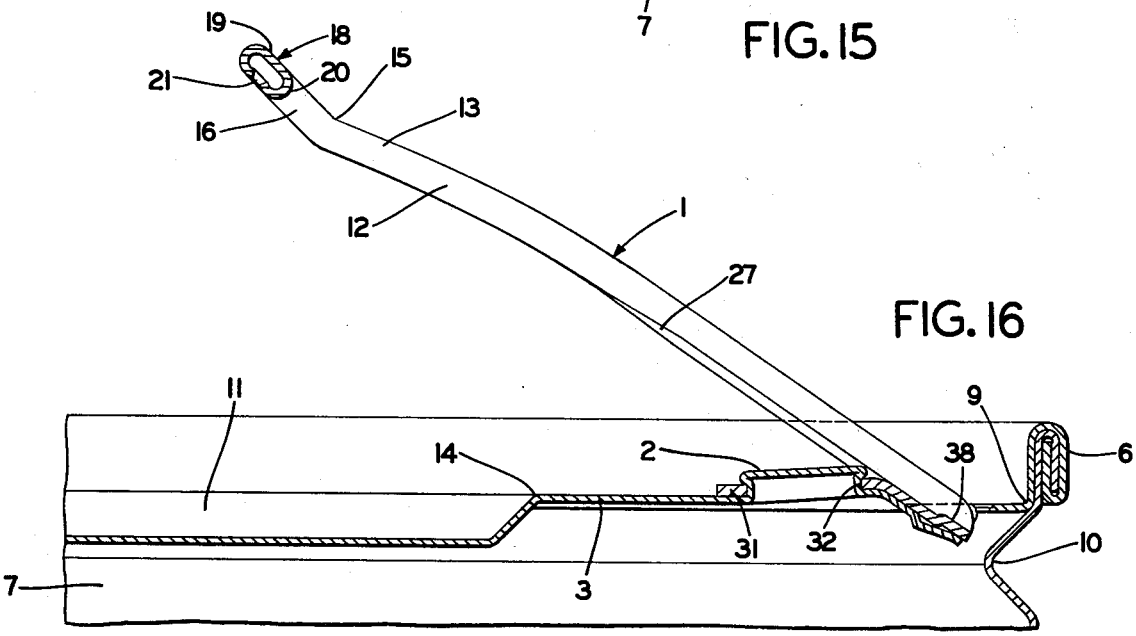
FIG. 16 illustrates a further stage in the rupturing operation.

Referring to FIGS. 13 through 16, a can 7 with a can end 5 provided with the improved pull tab 1 is illustrated in FIG. 13 prior to being opened. FIG. 14 illustates initial movement of the pull tab 1 to rupture the can end along the score line 4, with the back of the ring portion 12 raised, say, ¼ inch. Further opening movement of the pull tab raised ½ inch is shown in FIG. 15 and raised ¾ inch is shown in FIG. 16. Rupture occurs during the pull tab movement from FIG. 13 to FIG. 16.

Instron tests (a force-measuring instrument) on the new pull tab structure formed on 0.022 inch tab stock, give a reading of 19¼ lbs. at the position of FIG. 14, 27¼ lbs. at the position of FIG. 15, and 30¼ lbs. at the position of FIG. 16. These readings are typical.

Similar readings for pull tabs of types such as shown in U.S. Pat. Nos. 3,762,596 and 3,891,117 for tab pulls formed of 0.022 inch thick stock of the same metal were 12.93 lbs. for the position of FIG. 14, 20.87 lbs. for the position of FIG. 15, and 28.31 lbs for the position of FIG. 16.

These comparative readings indicate an increase in strength of about 50%, which represents the increased force that the tab can impart in fracturing the can end on the score line, without tab failure.

Figure 18:
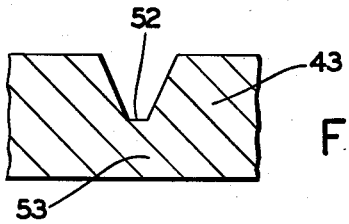
FIG. 18 is a fragmentary greatly enlarged sectional view taken on the line 18—18, FIG. 4, illustrating the panel-defining score line in section.

In fact, tests of the new tab structure have indicated that the metal of a can end of the same thickness as one scored as shown in FIG. 18, can be punctured in an unscored area by manipulation of the improved pull tab in a manner generally shown in FIGS. 13 and 15.

The prior art oval pull tab structure referred to above (U.S. Pat. No. 3,799,390) has weakness at the tip or nose end of the tab and such pull tabs have been found to fail in opening can ends even before the increased residuals were required in the art. Apparently attempts to compensate for the tab weakness have involved the moustache cut formed in the can end just ahead of the rivet joining the pull tab to the can end.

However, further indications of the reason for the weakness in such oval tabs are the absence of the present concept of the vertical parallel walls in the tab structure at either side of the rivet, and of the vertical walls on the 45° angle together with the location of the right-angled apex of the triangle formed by said walls in a flattened nose tip, such as the nose tip 38 in the instant structure with the nose tip 38 offset upward from the triangular nose bottom wall 30.

The increased strength of the improved tab structure doubles the integrity of a package having a can end provided with the improved tab. This increased integrity may be expressed as raising from 40 to 80 pounds the can-to-can pressure that may be sustained without fracturing any can end when cans are stacked one on another and subjected to can-to-can pressure.

Thus, the new tab structure of the invention has been able to satisfy the increased strength requirements demanded in the can industry without having to increase the thickness of the strip stock from which the pull tabs are made. As a result, major die revision of progressive die lines for the manufacture of the new pull tabs are avoided. Meanwhile, less material is used because of the increased amount of scrap that can be recovered incident to the cutout of metal to form the keyhole shape in the new pull tab structure.

Second Embodiment

Figure 19:
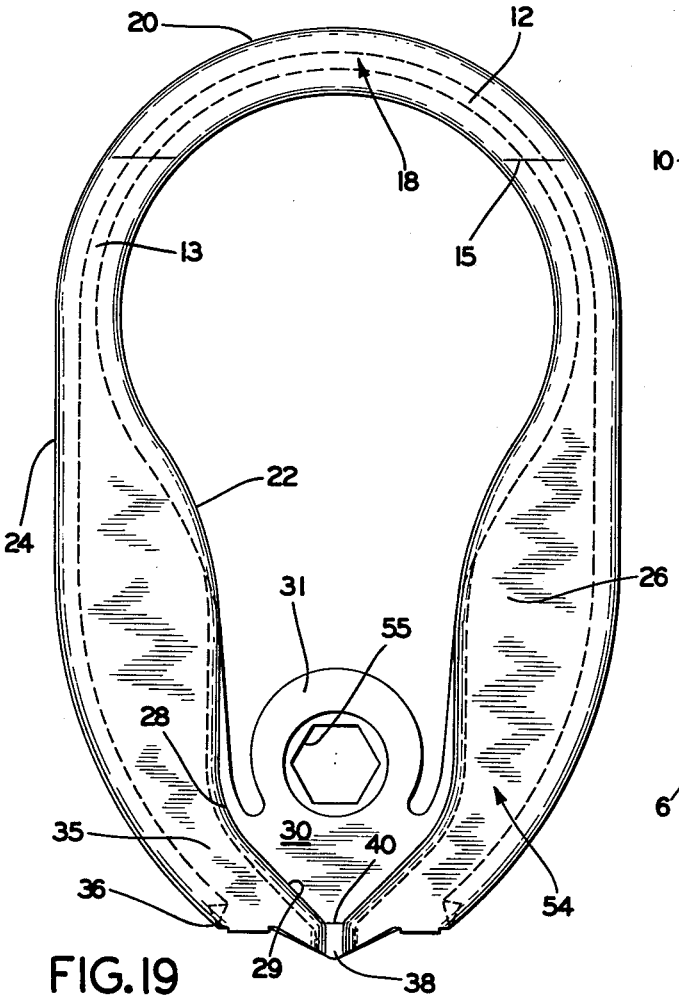
FIG. 19 is a view similar to FIG. 1 showing a slightly modified form of pull tab construction.
Figure 17:
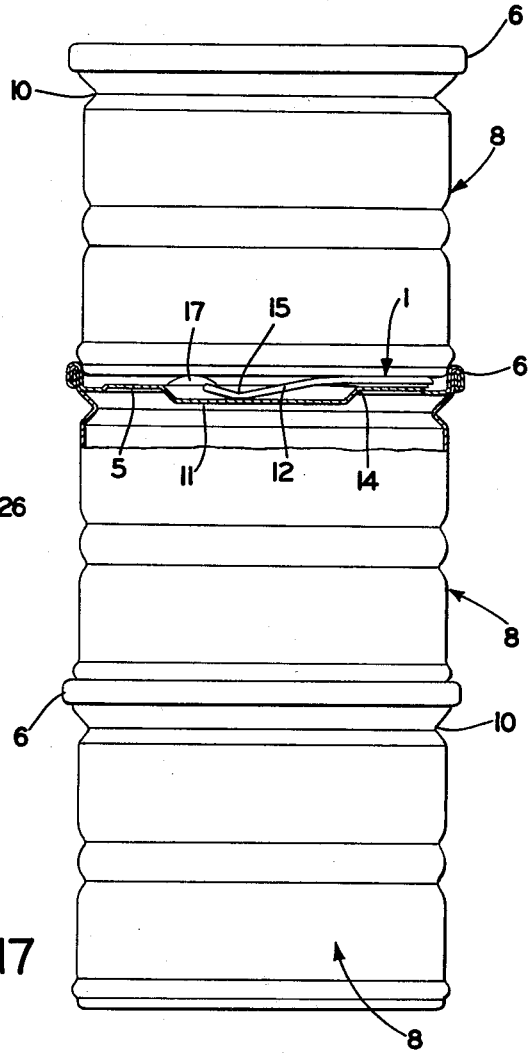
FIG. 17 is a view, with parts broken away in vertical section, illustrating a plurality of cans equipped with the improved pull tab stacked one on top of another.
Figure 20:
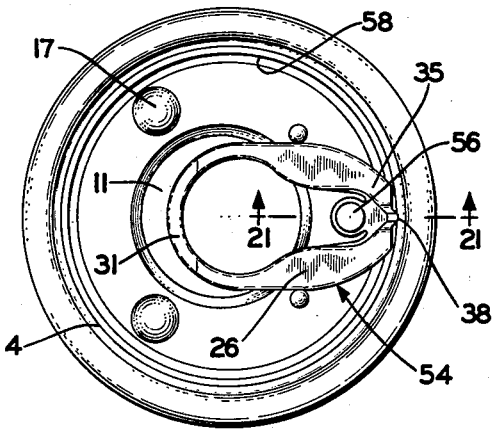
FIG. 20 is a view similar to FIG. 4 illustrating a can whose end has the pull tab of FIG. 20 riveted thereto.
Figure 21:
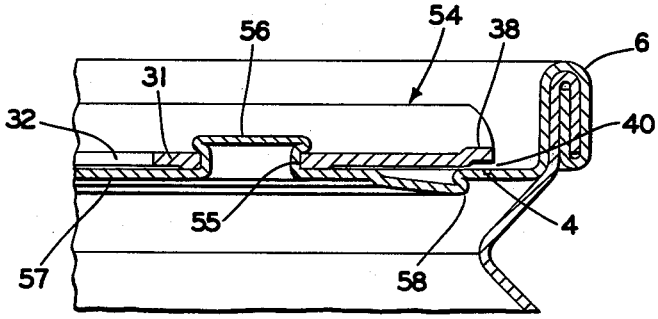
FIG. 21 is a sectional view looking in the direction of the arrows 21—21, FIG. 20.

The second embodiment of the invention is shown in FIGS. 19, 20 and 21 wherein the pull tab generally indicated at 54, shown in FIG. 19, is identical to the pull tab 1, shown in FIG. 1., excepting for the size and shape of the rivet hole 55 in FIG. 19. Rivet hole 55 preferably is hexagonal rather than round. The rivet 56 formed integrally in the can end 57 is smaller than the rivet 2 for the pull tab 1.

The pull tab 54 preferably is used in connection with a can end provided with a protective fold indicated at 58 in FIGS. 20 and 21. Such protective fold can end may be of the type illustrated in U.S. Pats. Nos. 3,891,117 and 3,941,277. The size and shape of the rivet hole is only a matter of choice, and thus the new tab structure is universal in use in that it may be used with several types of can ends as described.

IN GENERAL

The improved uniersal pull tab structure of the invention, exemplified in both embodiments described, overcomes deficiencies in prior art pull tabs, and at the same time provides greatly increased pull tab strength without increasing the tab metal thickness to provide increased initial rupturing forces to be applied by the pull tab for opening an easy opening can, with or without a protective triple fold bead formation in the can end; and thus provides a construction achieving the indicated objectives simply, efficiently and inexpensively, and solves existing problems and satisfies existing needs in the canned food products field.

In the foregoing description, certain terms have been used for brevity, clearness, and understanding; but no unnecessary limitations are to be implied therefrom beyond the requirements of the prior art because such terms are used for descriptive purposes and are intended to be broadly construed.

Moreover, the description and illustration of the invention in its several embodiments is by way of example, and the scope of the invention is not limited to the exact details shown or described, since the features of the invention may be applied to different sizes and types of cans.

Having now described the features, discoveries and principles of the invention, the manner in which the improved structures achieve the objectives, and the advantageous, new and useful results obtained; the new and useful structures, devices, elements, arrangements, parts, components, cooperative arrangements of components, combinations and subcombinations are set forth in the appended claims.

We claim:

1. A sheet metal pull tab for a full panel pull-out easy opening metal can including, flat top and rounded outer side walls forming a tab perimetric contour defined by spaced curved tab ring and nose ends connected by parallel tab sides; the flat tab top wall having an inner side wall defining a keyhole-shaped slot; the contour of the keyhole slot including a curved ring portion at the curved tab ring end connected by reversely curved portions to parallel portions extending toward the tab nose end; the rounded outer tab side wall having an inturned bead-forming flange extending around the tab perimeter ring end, parallel sides, and portions of the curved nose end, and ending in spaced bead terminals; the curved tab ring portion inner side wall being rounded and having an inturned bead-forming flange at the ring end, said last-mentioned bead-forming flange terminating at the reversely curved portion connections with said parallel keyhole portions; the inner keyhole slot side wall parallel portions being connected adjacent the tab nose end by portions curved inwardly toward the nose end; said last-mentioned inward curved inner side wall portions being connected with straight wall portions angled at 90° toward each other; the angled straight wall portions at the tab nose end extending downward from the flat tab top wall to and being connected with a generally right triangularly-shaped flat nose bottom wall; the parallel, inwardly curved, and straight angled tab inner side wall portions extending vertically downward from the flat tab top wall and vertically with respect to said flat nose bottom wall; the flat tab top wall at the tab nose end and the 90° angled straight tab inner side wall portions merging in a generally rectangular flat nose tip offset upward from the nose bottom wall in the zone of the projected intersection of the angled straight vertically oriented tab inner side wall portions; an ear extending rearward from the nose bottom wall; there being rivet-receiving aperture means formed in the ear; a narrow tapered side extension of the nose bottom wall located at either side of and spaced from the ear projecting toward the ear from the lower ends of the parallel keyhole vertical side wall portions; the narrow tapered side extensions terminating rearward of the nose bottom wall where the reversely curved inner side wall portions merge with the keyhole parallel inner side wall portions; there being curved slots formed between the ear and tapered side extensions; the curved slots having terminal zones located at hypotenuse corners of the right triangular nose bottom wall; the nose bottom wall right-angled corner being located adjacent the rectangular nose tip; the flat tab top wall having maximum width between adjacent parallel outer side and inner keyhole walls laterally of a tab centerline passing through the nose tip and rivet-receiving aperture means; and the flat tab top wall having a nose portion between each bead terminal and a straight angled nose wall portion whose width is approximately ½ the maximum top wall width measured on a line extending radially of the center of the rivet-receiving aperture means.

2. The construction defined in claim 1 in which the spaced bead terminals are flattened upward toward the tab top wall.

3. The construction defined in claim 1 in which the triangularly-shaped flat nose bottom wall is parallel with the nose end portions of the flat tab top wall portions located at either side of the nose tip.

4. The construction defined in claim 1 in which the generally rectangular flat nose tip is composed of sheet metal reformed from a tab wall portion upstanding from the nose bottom wall in the zone of the intersection of the 90° angled straight vertically oriented tab inner side wall portions.

5. The construction defined in claim 1 in which the offset nose tip has a slightly rounded outer edge.

6. The construction defined in claim 1 in which maximum tab nose wall occurs on each side of the tab at the connections of the reversely curved and parallel vertically oriented portions of the tab inner side wall where the bead-forming flanges and tapered nose bottom wall extensions terminate.

7. The construction defined in claim 1 in which the ring end of the pull tab is curved slightly rearwardly downward toward the tab ring end, to a laterally extending bend line spaced forwardly from the rear of the tab ring end; and in which the tab ring end is bent upwardly at said bend line.

8. The construction defined in claim 1 in which the rivet-receiving aperture means is a circular aperture.

9. The construction defined in claim 1 in which the rivet-receiving aperture means is a hexagonal aperture.

10. The construction defined in claim 1 in which stub ears remaining from severing the pull tab carrying strips used in progressive die formation of the pull tab project at either side of the nose tip from the nose end edges of the flat tab top wall portions located between the bead terminals and the nose tip.

11. The construction defined in claim 1 in which the connections of the parallel vertically oriented keyhole wall portions of the tab inner side wall, with the inwardly curved portions of the tab inner side wall, are located laterally opposite the center of the aperture means on a diametrical line passing through said center and normal to said parallel vertically oriented keyhole wall portions.

12. The construction defined in claim 11 in which said inwardly curved portions extend through 45° arcs about said aperture means center from the connections with said parallel vertically oriented keyhole wall portions to the connections with the angled straight wall portions.

13. In combination with a sheet metal pull tab as defined in claim 1; a full panel pull-out easy-opening can having a sheet metal can end of the class consisting of a plain panel can end and a can end provided with a protective fold at the peripheral edge of the panel to be pulled out; and rivet means connecting the pull tab with the can end.

14. In a sheet metal pull tab for a full panel pullout easy-opening metal can, a flat top wall having a ring end and a nose end formed with a ring portion at the ring end; the top wall nose end including spaced flat top wall nose end portions each having a vertically oriented inner nose wall extending downwardly therefrom; the inner nose walls being inwardly directed toward each other in the direction of the tab nose end and forming a 90° angle therebetween; a generally triangularly-shaped flat nose bottom wall; rivet-receiving means extending rearwardly from the nose bottom wall; the two angled vertically oriented inner nose walls being connected with the triangularly-shaped nose bottom wall; and a generally rectangular nose tip extending from the nose end of the pull tab parallel with the flat top and nose bottom walls and offset upwardly from said bottom wall at the juncture between the vertically oriented inner nose walls

15. The construction defined in claim 14 in which the inner nose walls have vertically oriented portions projecting rearwardly toward the ring end of the tab from the two angled vertically oriented inner nose walls; and in which narrow tapered side extensions of the nose bottom wall located at either side of and spaced from the rivet-receiving means project toward the rivet-receiving means from the lower ends of the rearwardly projecting portions of the inner nose walls.

16. The construction defined in claim 15 in which the portions of the inner nose walls projecting toward the ring end of the tab from the two angled vertically oriented inner nose walls include straight vertical wall portions connected by curved vertical portions with the angled vertically oriented inner nose walls.

17. The construction defined in claim 14 in which the generally rectangular nose tip is composed of sheet metal reformed from a tab wall portion upstanding from the nose bottom wall in the zone of the intersection of the two 90° angled vertically oriented tab inner nose walls.

* * * * *

UNITED STATES PATENT AND TRADEMARK OFFICE

CERTIFICATE OF CORRECTION

PATENT NO. : 4,042,144

DATED : August 16, 1977

INVENTOR(S) : George J. Henning, Lynn B. McKinney & Joseph Scalia

It is certified that error appears in the above-identified patent and that said Letters Patent are hereby corrected as shown below:

Column 1, Line 45 - "proressively" should be -progressively-;
Column 2, Line 11 - "meta" should be -metal-;
Column 2, Line 63 - insert the word -pull- after "oval-type";
Column 4, Line 21 - "sectiona" should be -sectional-;
Column 4, Line 63 - insert the word -can- after "whose";
Column 5, Line 35 - "cam" should be -can-;
Column 5, Line 36 - "downwardy" should be -downwardly-;
Column 5, Line 36 - omit the word "inwardly" after the word "downwardly";
Column 9, Line 63 - "on" should be -of-;
Column 11, Line 3 - "uniersal" should be -universal-; and
Column 12, Line 43 - insert the word -width- after the word "wall".

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*